US007140514B2

(12) United States Patent
Van Der Klaauw et al.

(10) Patent No.: US 7,140,514 B2
(45) Date of Patent: Nov. 28, 2006

(54) DRINKS DISPENSING DEVICE WITH A REMOVABLE HANDLE

(75) Inventors: Guido Petrus Johannes Van Der Klaauw, Zoeterwoude (NL); Bart Jan Bax, The Hague (NL); Marius Corstiaan Van Duuren, Poortugaal (NL)

(73) Assignee: Heineken Technical Services B.V., Zoeterwoude (NL)

( * ) Notice: Subject to any disclaimer, the term of this patent is extended or adjusted under 35 U.S.C. 154(b) by 338 days.

(21) Appl. No.: 10/296,975

(22) PCT Filed: May 31, 2001

(86) PCT No.: PCT/NL01/00424

§ 371 (c)(1),
(2), (4) Date: Sep. 11, 2003

(87) PCT Pub. No.: WO01/92145

PCT Pub. Date: Dec. 6, 2001

(65) Prior Publication Data

US 2004/0069805 A1 Apr. 15, 2004

(30) Foreign Application Priority Data

May 31, 2000 (NL) ..... 1015368

(51) Int. Cl.
*B67D 5/62* (2006.01)

(52) U.S. Cl. ..... 222/146.6; 222/129.1; 222/153.14; 222/386.5; 222/399; 62/389

(58) Field of Classification Search ..... 222/146.6, 222/131, 105, 183, 399, 400.7, 400.8, 464.1, 222/325, 386.5, 129.1, 129.2, 129.3, 153.01, 222/153.09, 153.14; 62/389, 399
See application file for complete search history.

(56) References Cited

U.S. PATENT DOCUMENTS 2,259,852 A * 10/1941 Hall ..... 62/376

(Continued)

FOREIGN PATENT DOCUMENTS

DE 91 01 144 4/1991

(Continued)

*Primary Examiner*—Frederick C. Nicolas
(74) *Attorney, Agent, or Firm*—Young & Thompson

(57) ABSTRACT

A drinks dispensing device (1, 25) is provided with a cooling chamber and a tap head for receiving a shut-off valve (32) of a drinks container which has been positioned in the cooling chamber. The tap head comprises a displacement member (45) and a seat (42) which is connected thereto. A handle (33) is removably connected to the seat and can be removed therefrom. Without the handle (33), it is difficult or impossible for the displacement member (45) to be moved by a user by hand, and consequently the drinks dispensing device cannot be operated by children. It is also possible for the user to exchange the handle for a handle of a specific appearance which matches the interior or is distributed by the producer of the drink which is to be dispensed in the event of promotional activities.

16 Claims, 6 Drawing Sheets

U.S. PATENT DOCUMENTS

| | | | | | |
|---|---|---|---|---|---|
| 2,349,441 | A | * | 5/1944 | Lund | 222/129.3 |
| 2,541,554 | A | * | 2/1951 | Smith | 169/71 |
| 2,582,752 | A | * | 1/1952 | Harr | 222/181.1 |
| 2,830,737 | A | * | 4/1958 | Brown | 222/129.1 |
| 3,323,686 | A | * | 6/1967 | Roth | 222/635 |
| 3,434,632 | A | * | 3/1969 | Batrow | 222/400.5 |
| 4,366,920 | A | * | 1/1983 | Greenfield et al. | 222/145.5 |
| 4,850,387 | A | * | 7/1989 | Bassill | 137/212 |
| 5,244,119 | A | * | 9/1993 | Pittman | 222/25 |
| 5,274,736 | A | * | 12/1993 | Rohr, Jr. | 392/447 |
| 5,368,205 | A | * | 11/1994 | Groh | 222/189.06 |
| 6,182,863 | B1 | * | 2/2001 | Van Der Meer et al. | 222/105 |

FOREIGN PATENT DOCUMENTS

| | | |
|---|---|---|
| EP | 0 382 914 | 8/1990 |
| WO | WO 99 11561 | 3/1999 |

* cited by examiner

DRINKS DISPENSING DEVICE WITH A REMOVABLE HANDLE

BACKGROUND OF THE INVENTION

The invention relates to a drinks dispensing device provided with a cooling chamber having a wall, and on one side an opening for receiving a drinks container, a shut-off valve, which is hingedly connected to the wall, for the purpose of shutting off the opening, and a tap head, which is connected to the wall and is used to receive a shut-off valve of a drinks container which has been positioned in the cooling chamber, the tap head comprising a displacement member, a seat connected to the displacement member and a handle connected to the seat.

DESCRIPTION OF THE RELATED ART

A drinks dispensing device of this type is known from PCT/NL99/00454. The known dispensing device comprises a cooling chamber in which packaging containing carbonated drink, such as beer, can be placed. The packaging containing carbonated drink comprises an outer container made from plastic and an inner, flexible bag which contains the carbonated drink. The flexible bag is connected, via a filing and dispensing head, to the neck of the outer container. The dispensing head is provided with a first, relatively wide filling passage, to which a filling head of a filling line can be connected for the purpose of filling the flexible bag. After the bag has been filled and the filling head of the filling line has been detached, the filling passage of the filling and dispensing head is closed by means of a spring-loaded valve. A second, relatively narrow dispensing channel of the filling and dispensing head is connected to a flexible hose which extends at right angles to the longitudinal direction of the container. Before the container is positioned in the cooling chamber of the drinks dispensing device, the dispensing passage is likewise closed off by means of a spring-loaded valve. A plastic outlet part which is provided with a guard bearing a brand name is attached at right angles to the end of the flexible hose, which outlet part can be positioned in a receiving part of the dispensing head of the drinks dispensing device. The dispensing head comprises two pivotable parts, which delimit a through-passage for the flexible line, and a shut-off valve connected to a tap handle. The shut-off valve comprises a spring-loaded valve mechanism which, through actuation of the tap handle, can squeeze shut the flexible hose in the through-passage and can also open this hose.

After the flexible hose has been positioned in the through-passage, the dispensing head is closed and the tap handle is placed in the closed position. It is then possible to close a cover of the dispensing device and pressure means, such as a compressor, can be connected to the container for supplying a pressurized medium to the space between the wall of the outermost container and the flexible bag. When the cover of the pressure chamber of the dispensing device is closed, the dispensing passage of the filling and dispensing head is opened, so that the contents of the flexible bag are forced into the flexible hose. Opening the tap handle opens the flexible hose so that it adopts its free, undeformed cross section, and the carbonated drink is dispensed from the dispensing head under pressure. The known dispensing device is also provided with a cooler, such as a Peltier element, for cooling the drink.

The known drinks dispensing device is intended to be positioned at an accessible location for the user so that the drink in a fitted drinks container, such as for example beer, can be kept under pressure for a period of a number of weeks at a cooled, drinkable temperature. It is in many cases desirable for the contents of the drinks dispensing device only to be accessible to some members of a family and, if the drinks container contains beer or another drink which is unsuitable for consumption by minors, for it to be easy to prevent the device from operating.

Furthermore, it is desirable for it to be easy to adapt the dispensing device according to the content of the dispensed drink, so that it is clear to a user what the drinks dispensing device contains.

A further requirement imposed on the drinks dispensing device is that its appearance can easily be adapted to the wishes of the user and for it to be possible for this appearance to be adapted to the interior of the environment in which it is used.

SUMMARY OF THE INVENTION

For this purpose, the drinks dispensing device according to the invention is characterized in that the handle can be removed from the seat by a user, it being impossible for a user to move the displacement member without a handle.

After the handle has been removed from the seat, the displacement member can no longer be moved by hand, or at least not without considerable effort, so that the drinks dispensing device is deactivated for young people, in particular children. This provides a very simple and effective childlock.

Furthermore, the fact that the handle can be removed means that it can be exchanged for a handle with a different appearance but with the same type of connecting member, so that the drinks dispensing device can be provided with a handle which corresponds to the contents. This makes it possible to use different types of beer with a matching handle, different types of soft drinks with a matching handle, etc., so that it will immediately be clear to the user what type of drink will be dispensed.

It is also possible for the handles to be of various designs and styles, for example to have a chromium-plated grip and Bakelite bottom, completely chromium-plated, with a handle designed as a golf ball and other specialized designs of this type.

According to one embodiment, the handle is provided with a connecting member which, in the vicinity of or below the surface of the seat, on the latter. The seat may, for example, have a cylindrical bore in which the handle is secured by means of a screwthread, bayonet fitting or spring pawl. It is also possible for the seat to comprise a pin of the displacement member, with a cavity lying transversely with respect to the pin, the handle being provided with a grip, a widened holding part and a connecting part which lies transversely with respect to the grip and is secured in the cavity in the pin.

The connecting member of the handle is preferably designed in such a manner that it can be removed and fitted by the user without having to use a tool.

BRIEF DESCRIPTION OF THE DRAWINGS

One embodiment of a drinks dispensing device according to the invention will be explained in more detail with reference to the appended drawing, in which.

DESCRIPTION OF THE PREFERRED EMBODIMENTS

Figure 1:
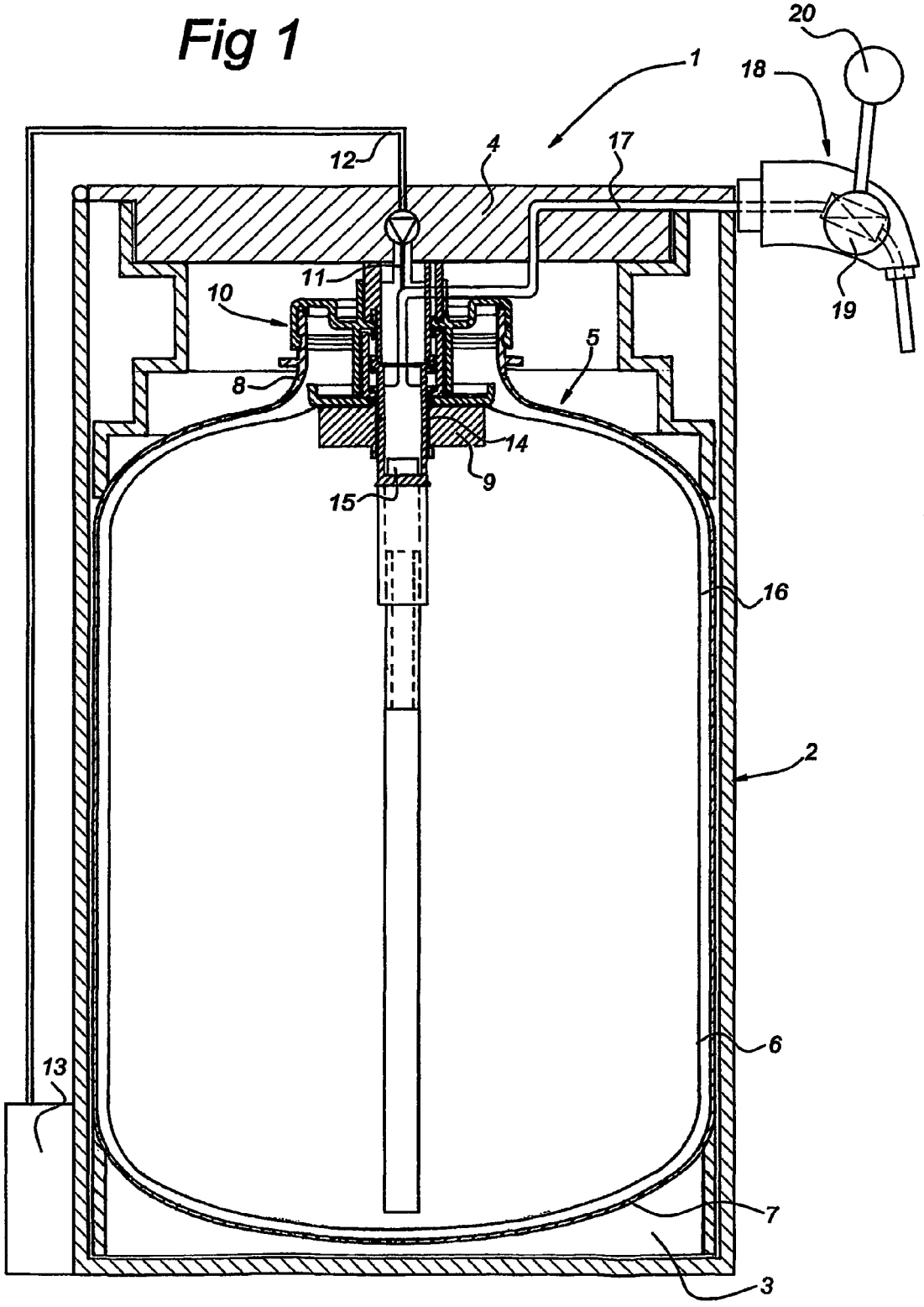
FIG. 1 shows a longitudinal section through a drinks dispensing assembly for use at the consumer's home.

FIG. 1 shows a drinks dispensing assembly 1 provided with a dispensing device 2 which has a cooling chamber 3 which can be closed off by a cover 4. A package 5 of carbonated drink is positioned in the cooling chamber 3. In the embodiments described below, the carbonated drink is beer, which is accommodated in a flexible bag 6 of the packaging 5 at a superatmospheric pressure of between 0 and 3 bar, for example 1 to 1.5 bar (the equilibrium pressure of $CO_2$ above beer). However, the packaging may also contain other carbonated drinks, such as soft drinks, at pressures which generally lie between 0 and 5 bar superatmospheric pressure.

The flexible bag 6 is accommodated in an outer rigid container 7 of the packaging 5 and, in the vicinity of a neck, is attached in a sealed manner to a flat lip 9 of a filling and dispensing head 10. The filling and dispensing head 10 comprises an air passage 11 which can be connected to a pressure line 12 in the cover 4, which pressure line is connected to a compressor 13. As an alternative to a compressor, it is also possible to use another form of pressure means, such as a precompressed gas, for example compressed air or pressurized $CO_2$ which is supplied from a separate cylinder. When the cover 4 is closed, a spring-loaded valve 14 of the filling and dispensing head 10 is displaced downwards, so that an outlet opening 15 is opened and an air passage in the head 10 leading to the space 16 between the flexible bag 6 and the rigid container 7 is opened, which air passage is in communication with the pressure line 12.

A flexible dispensing line 17 is connected to the filling and dispensing head 10, and, when the packaging 5 is placed in the cooling chamber 3, is connected to a dispensing head 18. The dispensing line 17 comprises, in the vicinity of an outlet end, a shut-off valve 19, which is positioned releasably in the dispensing head 18 and which has a normally closed position. When the packaging 5 is placed in the dispensing device 2 and the cover 4 is closed, so that the compressor 13 is activated, the shut-off valve 19 is closed and the beer is forced out of the flexible bag into the flexible line 17, until it reaches the shut-off valve 19, as a result of the pressure which is built up in the intervening space 16 by the compressor 13. By actuation of a handle 20, the shut-off valve 19, which forms an integral part of the dispensing line 17, can be opened and the beer can be tapped from the bag 6. When the packaging 5 is empty or, while the packaging is still partially full, another drinks package is placed into the dispensing device, the container 7 and the flexible dispensing line 17 connected thereto, together with the closed shut-off valve 19, are removed from the cooling chamber 3. The container 7 of the empty packaging 5, which may be formed, for example, from plastic, such as PET or ABS, can be reused, while the flexible bag 6, the filling and dispensing head 10 and the flexible line 17, together with the shut-off valve 19, can be designed for a single use and can be thrown away or recycled after use. For further details of the drinks dispensing device 2, reference is made to international patent application PCT/NL99/00454, in the name of the applicant, the content of which application is incorporated in the present application by way of reference.

Figure 2:
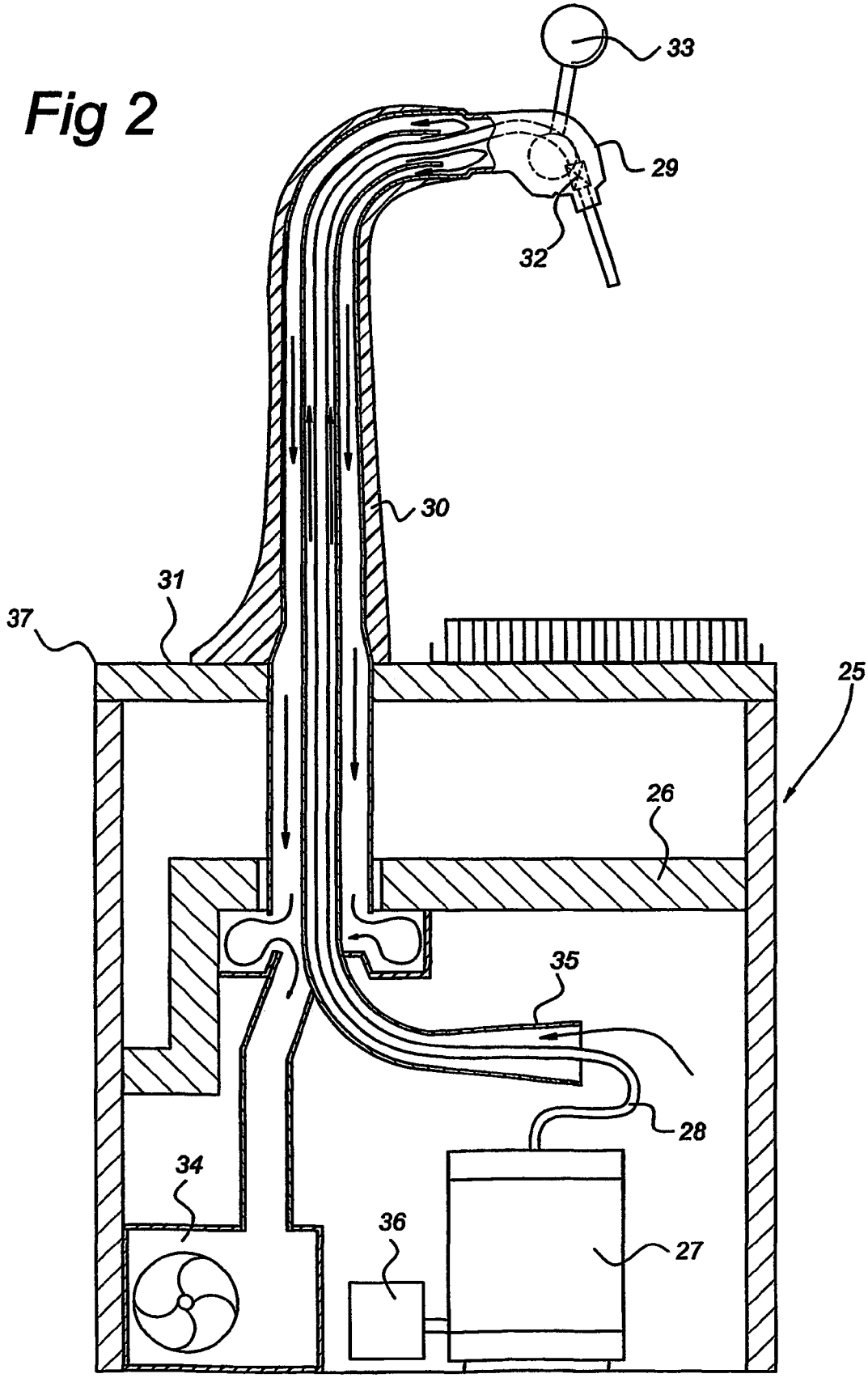
FIG. 2 shows a longitudinal section through an embodiment of a drinks dispensing assembly which is suitable for use at small-scale catering establishments.

FIG. 2 shows an embodiment of a drinks dispensing device 25 which is particularly suitable for use in catering establishments. The dispensing device 25 comprises a cooled compartment, or refrigerator, 26 in which there is a container 27 holding a carbonated drink. The container 27 may comprise a double-walled package with a rigid outer enclosure in which there is a flexible bag as shown in FIG. 1, but may also comprise a metal container, such as a stainless-steel beer barrel which is known per se. The volume of the container 27 may vary from a few liters to 50 litres or more. A compressor or $CO_2$ cartridge 36 is connected to the container 27. Furthermore, as an alternative to a compressor or $CO_2$ cartridge, it is possible for a cartridge containing carbon and $CO_2$ to be positioned in the container 27 for the purpose of generating the desired pressure, as described in international patent application PCT/NL/99/00144. The container 27 is connected, via a flexible plastic dispensing line 28, to a dispensing head 29. The dispensing head 29 forms part of a tap pillar 30 which is attached to the counter of a bar 31. A shut-off valve 32 according to the present invention is fitted at the outlet end of the flexible line 28 which valve can be opened and closed by means of handle 33 at the end of the tap pillar 30.

A cooling element (not shown in more detail), which cools the air which is present in the refrigerator 2, to, for example, 5° C.–10° C., is accommodated in the interior of the refrigerator 26. A fan 34 is used to suck warm air out of the hollow tap pillar 30 back to the refrigerator 26. As a result of the partial vacuum which occurs as a result in the dispensing head 29, cold air is passed from the refrigerator 26, via a guide tube 35 in which the flexible dispensing line 28 is accommodated and which opens out in the dispensing head 29, through the guide tube 35 and along the dispensing line 28. As a result, the drink is cooled to, for example, 8° C. The device described above is shown in more detail in Dutch patent application 1015359, which was filed on 31 May 2000 in the name of the applicant, bearing the title "Tap device and container therefor, and method for its production".

Figure 3:
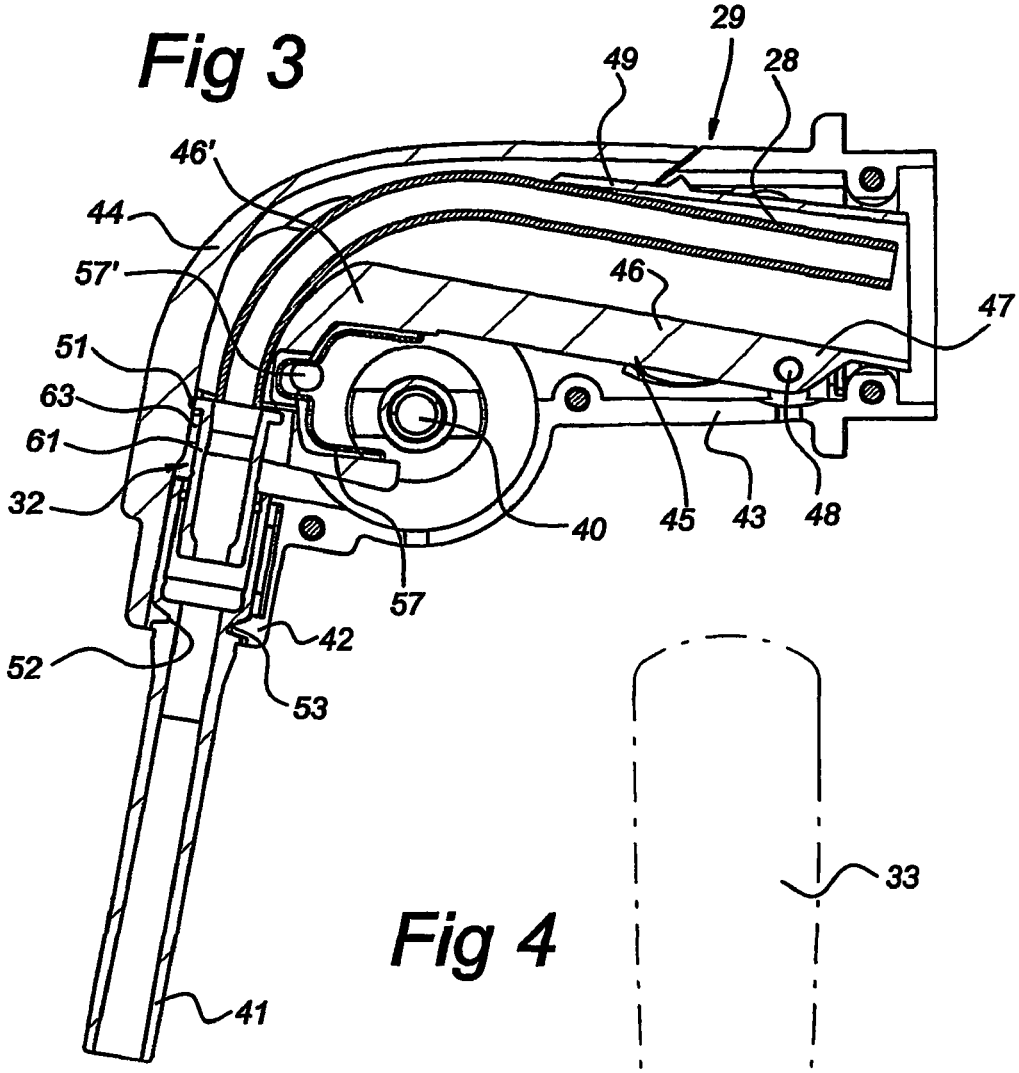
FIGS. 3 and 4 show cross sections through the dispensing head of the drinks dispensing device according to the invention.

FIG. 3 shows a longitudinal section through the dispensing head 29 shown in FIG. 2. The handle 33 is connected to the housing 43 in such a manner that it can rotate about a pin 40, and acts via a spring 57 and projection 57' on actuating member 45 for the purpose of opening and closing the shut-off valve 32. The free travel of the handle 33 can be set by the positioning of projection 57' with respect to the actuating member 45. In the position shown in FIG. 3, the projection 57' acts directly on the actuating member 45, so that the shut-off valve 32 is opened and closed with a small displacement of the handle 33. Exchanging the projection 57' for a projection 57' which lies further to the right compared to the projection shown in FIG. 3 will allow the handle 33 a longer free travel before it acts on the actuating member 45. As a result, it is possible to achieve complete opening and closure of shut-off valve 32 with a long travel, such as 90°, of the handle 33. By simply exchanging the projection 57', it is possible to adjust the travel of the handle 33 between the relatively short travel (for example 10°), as shown in FIG. 3, and a relatively long travel, such as 90°.

The spring 57 allows a certain movement of the handle 33 without causing displacement of the actuating member 45, and play is eliminated from the rotation of the handle about the pin 40.

An outlet end 41 of the flexible dispensing line 28, which is guided along a curved section through the dispensing head 29, is accommodated in the seat 42 of the dispensing head. The outlet end 41, which is made from rigid plastic, is provided with a circumferential slot 52 in which an edge 53 of the seat 42 of the dispensing head 29 engages in order to securely hold the outlet end 41.

The dispensing head 29 comprises a fixed bottom part of the housing 43, to which a cover 44 is connected so that it can execute a hinged movement between a closed position and an open position, in which the outlet end 41 and the shut-off valve 32 of the line 28 can be placed in the dispensing head 29.

The actuating member 45 comprises a substantially horizontal arm 46 which, by means of a first end, is pivotably connected to a pin 48. The flexible dispensing line 28 is positioned, via a guide 49 attached to the top side of the actuating member 45, in a curved path against a curved end 46' of the actuating member 45.

Coupling means of the shut-off valve 32, which are formed, for example, by a flange 51 on a slidable sleeve 61, are connected to a coupling member at the end of the curved end 46' of the arm 46. The coupling member may suitably be designed as a fork 63 which engages behind the flange 51 of the shut-off valve 32.

Figure 4:
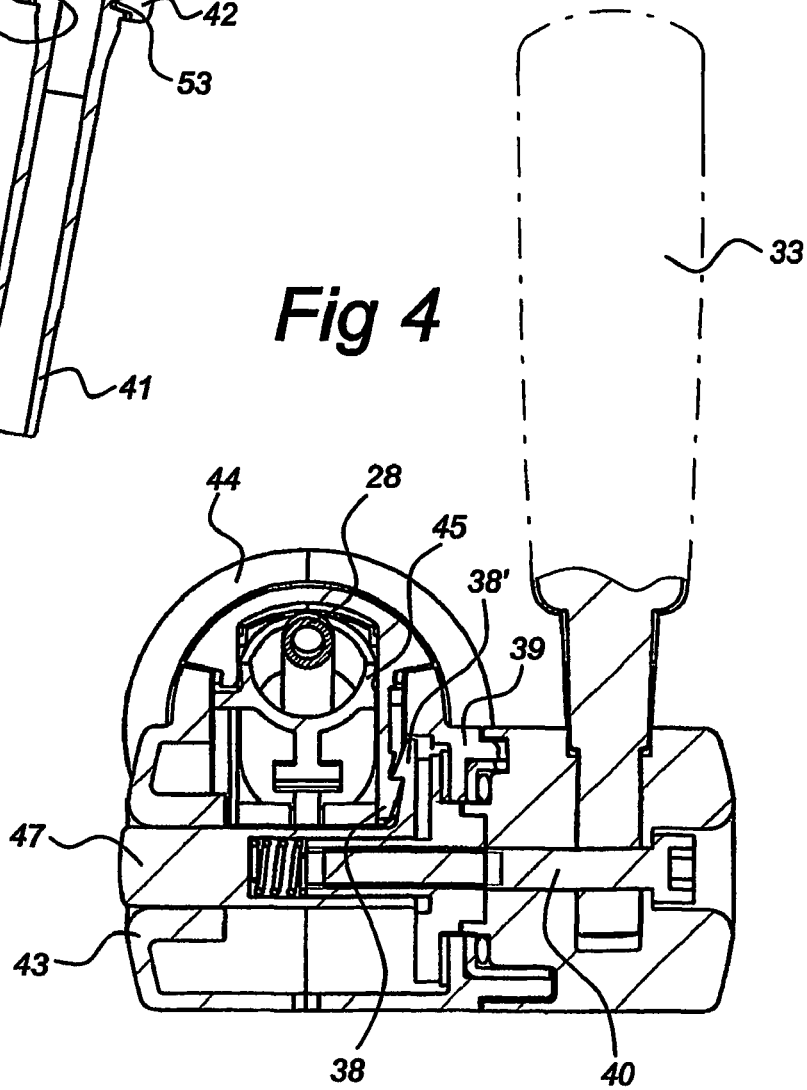

FIG. 4 shows the pin 40 attached to the handle 33 for moving the actuating member 45. The pin 40 is provided on one side with a spring pawl 47 which, at its end, bears a tooth 38' which runs at right angles to the pin 40. The hinged cover 44 of the dispensing head 29 comprises a complementary tooth 38 which engages behind the tooth of the spring pawl 47. In the upright position of the handle 33, in which the shut-off valve 32 is closed, an unlocking projection 39, which is likewise connected to the pin 40, is positioned in such a manner that spring pawl 47 can be depressed, the tooth 38' engaging in the receiving cavity in the unlocking projection 39. This position is shown in FIG. 4, so that with a closed shut-off valve 32 and an upright handle 33, the cover 44 can be released from the bottom part of the housing 43 and can hinge open about hinge pin 60.

Figure 5:
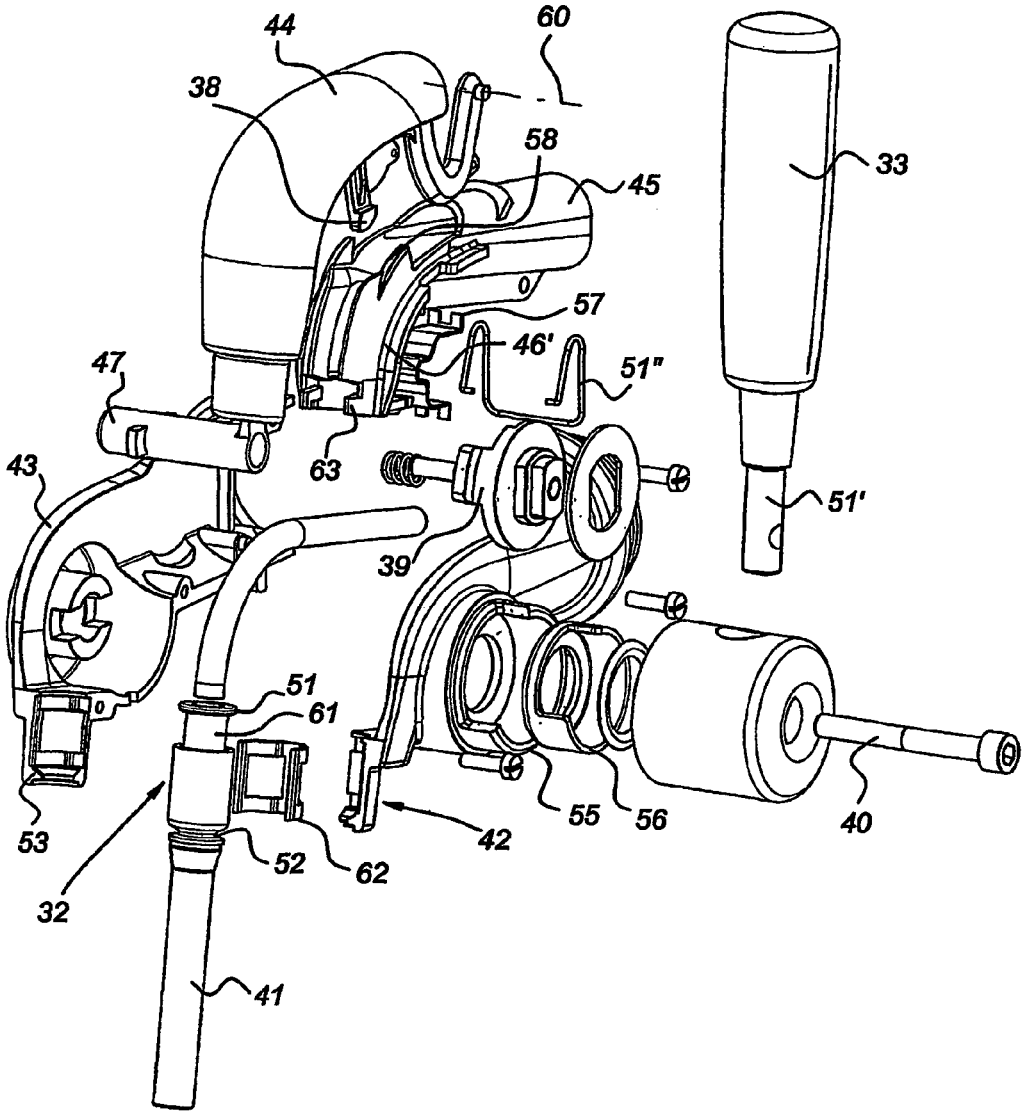
FIG. 5 shows an exploded view of the dispensing head shown in FIGS. 3 and 4.

As can be seen from FIG. 5 the grip 51' of handle 33 is accommodated removably inside a cut-out in the wall of two concentric annular sleeves 55, 56. As a result of the sleeve 56 being rotated about its centre axis with respect to the sleeve 55, or as a result of the sleeve 56 being omitted altogether, it is possible to adjust the travel of the handle 33 between, for example, 90° and 10° by making the openings in the walls of the rings 55, 56 coincide or by positioning them in offset positions.

On the top side of the actuating member 45 there is a stop 58 against which, when the dispensing line 28 is being introduced into the dispensing head 29 via the guide sleeve 35 shown in FIG. 2, the shut-off valve 32 comes into contact, thus preventing the shut-off valve 32 from being pushed through too far until it lies outside the dispensing head 29.

Furthermore, FIG. 5 shows a spring element 51" which is connected to the cover 44, in order, in the event of actuation of the spring pawl 47 and unlocking of the cover 44, to move the cover into the raised position.

It is clear from FIG. 5 that the end 46' of the actuating member 45 is in the shape of a curved saddle which guides the flexible line 28 from a horizontal position to a substantially vertical position without kinking or sharp bends, this saddle ending in a fork 63 in which the flange 51 of the inner sleeve 61 of the shut-off valve 32 can be positioned. A separate clamping spring 62 is arranged in the seat 42 as a separate component, in order to position the shut-off valve 32 so that it is clamped with respect to the seat 42 when the cover is open, so that the cover 44 can be closed. In this case, the edge 53 on the seat 42 and the circumferential slot 52 of the outlet end 41 form a relatively airtight closure, thus preventing air from being sucked past the outlet end 41 into the cooled tap pillar 30.

When the dispensing line 28, which on account of its rigidity can push the shut-off valve 32 and the outlet end 41 through the guide tube 35, is being introduced and pulled out, the closed shut-off valve 32 prevents beer from leaking into the guide tube 35. When the shut-off valve 32 is being introduced into, or removed from, the fork 63, the innermost sleeve 61 is therefore positioned in its retracted position, so that the shut-off valve 32 is closed. By using the dispensing head 29 in combination with the flexible dispensing hose 28, which is provided with shut-off valve 32 in the vicinity of the outlet end 41, it is possible for the dispensing line 28 to be positioned quickly and easily, so that an empty container of carbonated drink can easily be replaced by a full container. Since, in the process, the entire dispensing line 28 is also replaced, it is possible to eliminate frequent cleaning of the dispensing line, which, in particular for beer taps, involves considerable time and expense.

Figure 6:
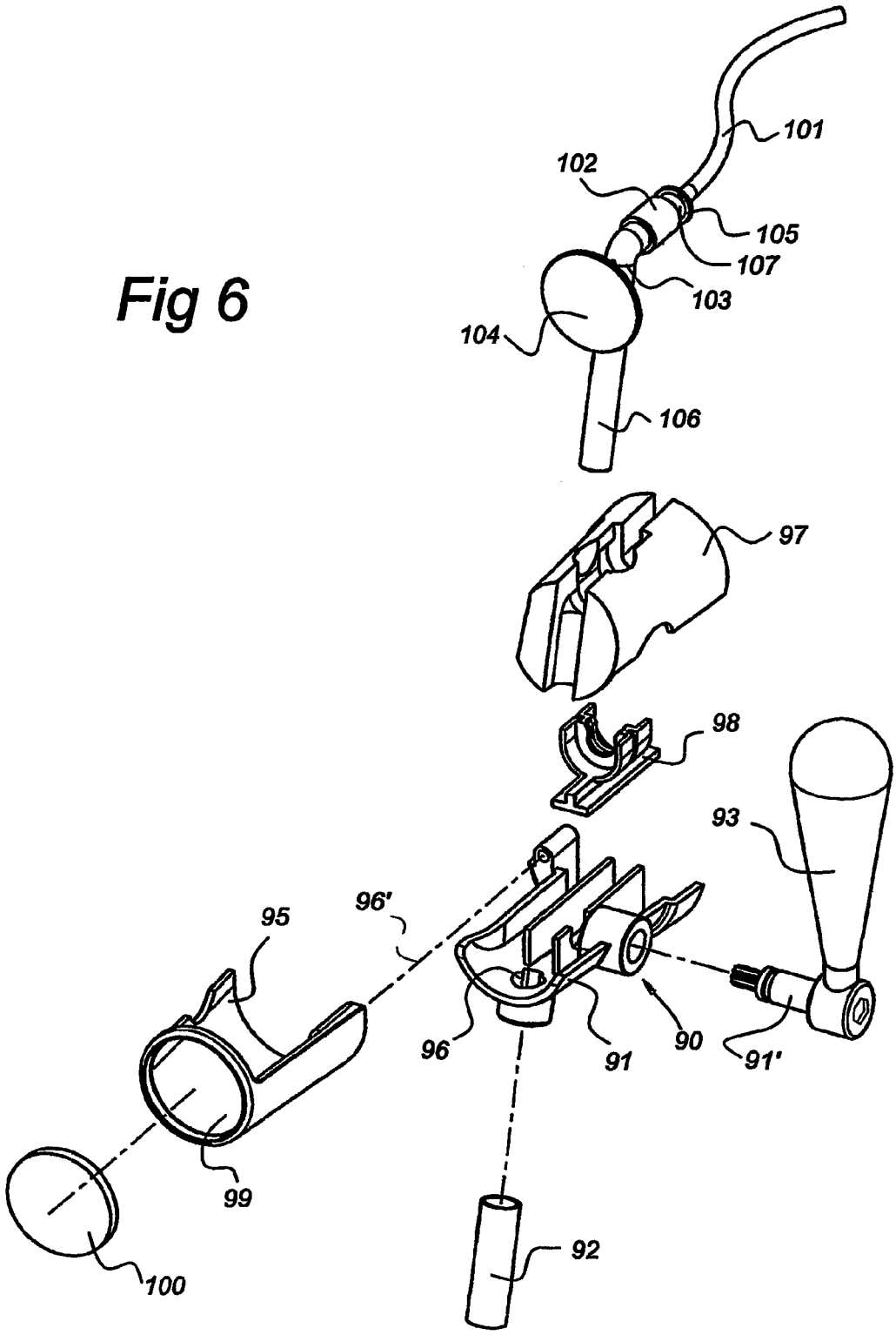
FIGS. 6 and 7 show an exploded perspective view and an assembled perspective view, respectively, of a further embodiment of a drinks dispensing head.
Figure 7:
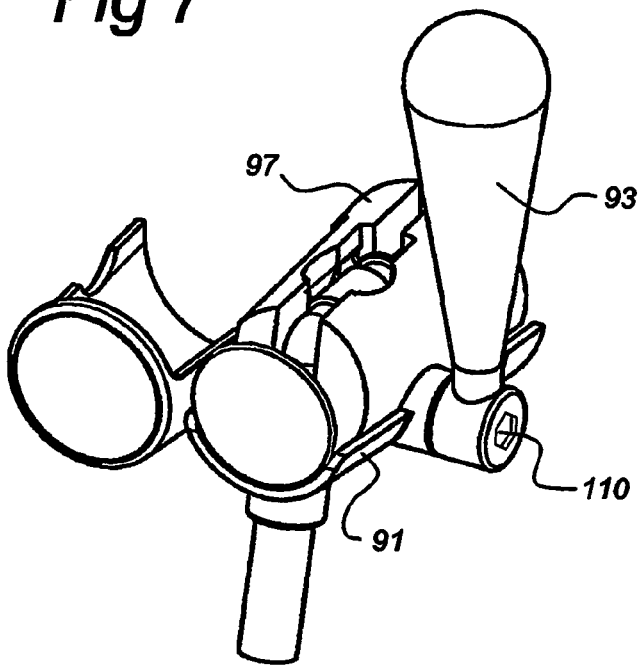

FIGS. 6 and 7 show an embodiment of a dispensing head 90 and dispensing line 101 for use in a dispensing device as shown in FIG. 1. The dispensing head 90 comprises base part 91 with the handle 93 attached to it, together with a connecting member 91' which lies transversely to the handle. The base part 91 is provided with a bore 96 and a receiving tube 92 for receiving a right-angled outlet end 103 of the flexible dispensing line 101. The base part 91 is also provided with a receiving part 97 for receiving the flexible dispensing line 101 and the shut-off valve 102, and with an actuating member or guide 98, which can be moved in the axial direction along the receiving part 97 and is connected to the handle 93 for actuating the shut-off valve 102 of the dispensing line 101. The guide 98 may be designed in the same way as the fork 63 which is shown in FIG. 5 and acts on the flange 105 of the innermost sleeve 107 of the shut-off valve 102 in FIG. 7.

Furthermore, the dispensing head 90 is provided with a top part 95 which is connected to base part 91 in such a manner that it can execute a hinged movement about a hinge axis 96'. The top part 95 comprises a chamber 99 for accommodating a plate 104 at the end of dispensing line 101. The plate 104 of a dispensing line 101 which has been placed in the dispensing head 90 is visible via an opening or window 100, so that the contents of the drinks dispensing device can be established. The window 100 may have a curved and therefore enlarging form.

FIG. 7 shows the assembled dispensing head of the type shown in FIG. 6. The shut-off valve 102 is connected to the outlet end 103 which lies at right angles thereto and is positioned in the bore 96 in the dispensing head 90. Furthermore, the plate 104 of the outlet end 103 is provided with visual symbols so that it is possible to establish the type of carbonated drink when the plate 104 is positioned in the chamber 99 of the dispensing head. Consequently, an accurately defined position of the outlet end 106 is ensured after the top part 95 has been hinged shut, resulting in a favourable tap performance. Furthermore, the handle 93 is provided with a socket-head screw 110 for releasable connection to the base part 91.

Figure 8:
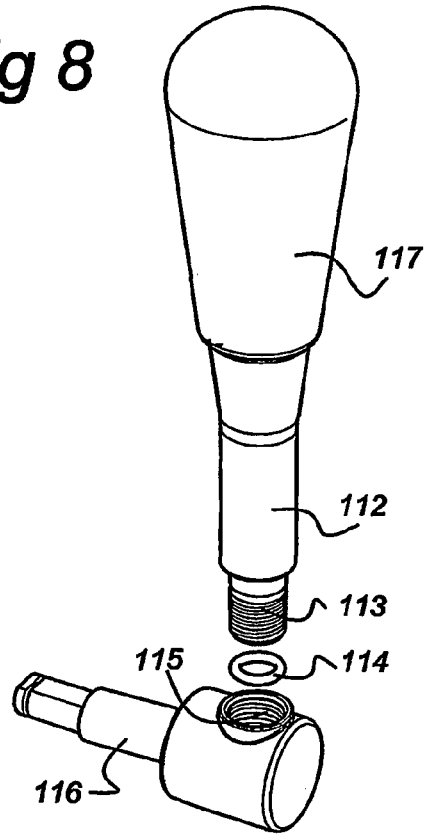
FIG. 8 shows a releasable handle which can be attached by means of a screwthread.

Finally, FIG. 8 shows an embodiment in which the handle 112 can be releasably connected, via a screwthread 113 and O-ring 114, to a bore 115 at the end of the pin 116. After the handle 112 has been removed, the pin 116 can no longer be rotated, or at least can only be rotated with great difficulty, by hand, so that it is no longer possible for children to get the drink dispensed. It is also possible for the handle 112 to be replaced by a similar type of handle with a different appearance, for example with a top part 117 which is made from stainless steel, chromium, plastic, wood, etc.

The invention claimed is:

1. Drinks dispensing device, comprising:

a cooling chamber having a wall and an opening for receiving a drinks container, a shut-off cover hingedly connected to the wall and operative to shut off the opening, a dispensing line for dispensing drinks from the drinks container, and a tap head connected to the cooling chamber, the tap head including a shut-off member located in the dispensing line of the drinks container which has been positioned in the cooling chamber, the tap head comprising a displacement member, a seat connected to the displacement member, and a handle connected to the seat, wherein, the handle is removably located the seat by a user so that movement of the displacement member by hand without the handle is difficult, the handle is provided with i) a connecting member in the vicinity of or below the surface of the seat or ii) a pin connected to the seat, the pin or the member acting on the seat, the seat comprising a transverse axis and a connecting bore extending substantially transversely to said axis, the seat receiving the connecting member which engages with the bore via an O-ring or via a screw thread.

2. The drinks dispensing device according to claim 1, characterized in that the handle comprises a grip of a widened holding part, the connecting member lying transversely to the grip.

3. The drinks dispensing device according to claim 1, characterized in that the connecting member can be removed without having to use a tool.

4. The drinks dispensing device according to claim 1, characterized in that the device comprises pressure means for connection to the container positioned in the device.

5. The drinks dispensing device according to claim 2, characterized in that the connecting member comprises a spring pawl.

6. The drinks dispensing device according to claim 5, characterized in that the device comprises pressure means for connection to the container positioned in the device.

7. The drinks dispensing device according to claim 2, characterized in that the device comprises pressure means for connection to the container positioned in the device.

8. The drinks dispensing device according to claim 3, characterized in that the device comprises pressure means for connection to the container positioned in the device.

9. A drinks dispensing device comprising:

a cooling chamber, the cooling chamber receiving a drinks container;

a dispensing head;

a dispensing line having an inlet end connected to the drinks container, an outlet end to dispense drinks from the dispensing head, and an intermediate portion located within the dispensing head;

a shut-off valve integrally fitted with dispensing line and located within the dispensing head;

an actuating member located within the dispensing head and proximate to the shut-off valve such that movement of the actuating member controls opening of the shut off valve;

a connecting bore located on the dispensing head below the dispensing line and positioned transversely to the dispensing line;

a pin extending through the connecting bore and connected to the actuating member, a distal end portion of the pin being located outside and adjacent to the connecting bore;

a user-removable handle engaged with the pin;

a child lock located exteriorly from the connecting bore, operatively connected to the pin, and operatively engaged with the handle, wherein, removably engaged in the screw-threaded handle-receiving bore, angular displacement of the handle causing movement of the actuating member and opening the shut-off valve and to dispense the drinks, and the handle is user-removable from the child lock by unthreading the screw-threaded bore, rendering movement of the actuating member difficult.

10. The device of claim 9, wherein, the child lock comprises a screw-threaded handle-receiving bore located the distal end portion of the pin, the handle-receiving bore transverse to the connecting bore, and the handle comprises a screw thread distal end user-removably engaged in the screw-threaded handle-receiving bore, the handle is user removable by unthreading the handle from the screw-threaded bore.

11. A drinks dispensing device comprising: a cooling chamber, the cooling chamber receiving a drinks container; a dispensing head; a dispensing line having an inlet end connected to the drinks container, an outlet end to dispense drinks from the dispensing head, and an intermediate portion located within the dispensing head; a shut-off valve integrally fitted with the dispensing line and located within the dispensing head; an actuating member located within the dispensing head and proximate to the shut-off valve such that movement of the actuating member controls opening of the shut off valve; a connecting bore located on the dispensing head below the dispensing line and positioned transversely to the dispensing line; a pin extending through the connecting bore and connected to the actuating member, a distal end portion of the pin being located outside and adjacent to the connecting bore; a user-removable handle engaged with the pin; and a child lock located exteriorly from the connecting bore, operatively connected to the pin, and operatively engaged with the handle, wherein, the child lock comprises an annular projection extending from the connecting bore such that the pin extends through the annular projection, the annular projection having a handle-receiving bore transverse to the connecting bore, the handle includes a distal end portion with a pin receiving bore, the pin engaged through the pin receiving bore, and the distal end portion of the handle is user-removably engaged with the handle-receiving bore of the annular projection via the pin, angular displacement of the handle causing movement of the actuating member and opening the shut-off valve to dispense the drinks, and the handle is user-removable from the child lock by removing the pin from the connecting bore and from the pin receiving bore, rendering movement of the actuating member difficult.

12. The drinks dispensing device of claim 9, wherein the handle is connected to the child lock by one of a screw thread and a pin receiving bore.

13. The drinks dispensing device of claim 9, wherein the screw-threaded handle-receiving bore further includes an O-ring.

14. A drinks dispensing device comprising:

a cooling chamber with an opening, the cooling chamber receiving a drinks container with a valve-actuated pressurized gas line;

a cover arranged to simultaneously close off the chamber opening and actuate the valve of the drinks container received and pressurize the drinks container;

a dispensing head;

a dispensing line having one end connected to the drinks container and a portion located within the dispensing head;

a shut-off valve integrally fitted with the dispensing line and located within the dispensing head;

an actuating member located within the dispensing head and proximate to the shut-off valve such that movement of the actuating member controls opening of the shut off valve;

a connecting bore located on the dispensing head below the dispensing line and positioned transversely to the dispensing line;

a pin extending through the connecting bore and connected to the actuating member, a distal end portion of the pin being located outside and adjacent to the connecting bore; and a user-removable handle pivotally connected to the actuating member via the pin, wherein displacement of the handle controls the actuating member and thereby controls drink dispensing, and removal of the handle hinders the drink dispensing.

15. The device of claim 14, wherein a screw-threaded handle-receiving bore is located at the distal end portion of the pin, the handle-receiving bore transverse to the connecting bore, and the handle comprises a screw thread distal end user-removably engaged in the screw-threaded handle-receiving bore, the handle is user-removable by unthreading the handle from the screw-threaded bore.

16. The device of claim 14, wherein, the handle includes a pin receiving bore, the pin engaged through the pin receiving bore, and the handle is user-removable by removing the pin from the connecting bore and from the pin receiving bore.

* * * * *